US010369711B2

(12) United States Patent
Washington et al.

(10) Patent No.: US 10,369,711 B2
(45) Date of Patent: Aug. 6, 2019

(54) SHAVING RAZOR CARTRIDGE

(71) Applicant: The Gillette Company, Boston, MA (US)

(72) Inventors: Jack Anthony Washington, Quincy, MA (US); William Owen Jolley, Spencer, MA (US)

(73) Assignee: The Gillette Company LLC, Boston, MA (US)

( * ) Notice: Subject to any disclaimer, the term of this patent is extended or adjusted under 35 U.S.C. 154(b) by 90 days.

(21) Appl. No.: 15/079,474

(22) Filed: Mar. 24, 2016

(65) Prior Publication Data

US 2016/0279817 A1 Sep. 29, 2016

(30) Foreign Application Priority Data

Mar. 25, 2015 (EP) ..... 15160876

(51) Int. Cl.
*B26B 21/40* (2006.01)
*B26B 21/44* (2006.01)
*B26B 21/22* (2006.01)

(52) U.S. Cl.
CPC ..... *B26B 21/4018* (2013.01); *B26B 21/227* (2013.01); *B26B 21/4012* (2013.01); *B26B 21/4031* (2013.01); *B26B 21/443* (2013.01)

(58) Field of Classification Search
CPC ..... B26B 21/4018; B26B 21/4012; B26B 21/443; B26B 21/4031; B26B 21/227; B26B 21/565; B26B 21/4068; B26B 21/4075; B21B 53/645
USPC ... 30/34.2, 50, 526, 527, 532, 47, 63, 346.5, 30/77, 84, 41, 41.5, 57
See application file for complete search history.

(56) References Cited

U.S. PATENT DOCUMENTS

| | | | | |
|---|---|---|---|---|
| 4,168,571 | A | 9/1979 | Francis | |
| 4,492,024 | A * | 1/1985 | Jacobson | B26B 21/227 30/50 |
| 4,939,840 | A | 7/1990 | Butka | |
| 5,224,267 | A * | 7/1993 | Simms | B26B 21/4068 30/50 |
| 5,369,885 | A * | 12/1994 | Ferraro | B26B 21/227 30/41 |
| 5,416,974 | A | 5/1995 | Wain | |
| 2003/0159291 | A1 | 8/2003 | Clark | |
| 2009/0113717 | A1 | 5/2009 | Rawle | |
| 2009/0288304 | A1 | 11/2009 | Denkert et al. | |

(Continued)

OTHER PUBLICATIONS

PCT International Search Report with Written Opinion in corresponding international application PCT/US2016/021715 dated May 25, 2016.

(Continued)

*Primary Examiner* — Ghassem Alie
(74) *Attorney, Agent, or Firm* — John M. Lipchitz

(57) ABSTRACT

A shaving razor cartridge with a housing with a guard and a cap. At least one blade is mounted to the housing. The at least one blade has a cutting edge. At least one blade registration member is mounted to the housing. A blade retention member secures the at least one blade between the blade registration member and the blade retention member. The blade registration member has an unsupported region with a span of 0.25 mm to 5 mm between a pair of supported regions.

20 Claims, 9 Drawing Sheets

(56) References Cited

U.S. PATENT DOCUMENTS

| | | | | |
|---|---|---|---|---|
| 2009/0293281 | A1* | 12/2009 | Bruno | B26B 21/222 30/50 |
| 2012/0047743 | A1* | 3/2012 | Kemos | B21D 53/645 30/32 |
| 2015/0174774 | A1* | 6/2015 | Hodgson | B26B 21/14 30/34.2 |

OTHER PUBLICATIONS

EPO Search Report with Written Opinion in corresponding EPO application 15160876.7 dated Sep. 16, 2015.

* cited by examiner

SHAVING RAZOR CARTRIDGE

FIELD OF THE INVENTION

The present invention relates to wet shaving safety razors and more particularly to shaving cartridges that have a housing for retaining and/or fixing one or more blades.

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled.

Razor blade assemblies have been disclosed wherein cutting edge portions of the blade members are held between skin engaging surfaces which are generally referred to as the guard and cap of the razor blade assembly. The guard contacts the skin in front of the blade member(s) and the cap contacts the skin behind the blade member(s) during a shaving stroke. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

In U.S. Pat. Nos. 4,586,255 and 4,378,634, the blade members are disclosed that are independently movable in response to forces encountered during the shaving operation by virtue of their being supported by spring finger biasing members integral with the body member, which exercise a bias against the blades during the shaving operation. In addition, mounting the blades on spring members, such as cantilever beams, may also be used to set the blade geometry by biasing the blades against a registration surface, such as clips.

In the construction wherein the blade support spring finger biasing members are formed integral with the body member, it is necessary to choose a material for the body member which demonstrates the proper qualities to provide a spring member, yet will demonstrate those qualities of durability necessary to provide a suitable housing for the blades, the cap and guard portion of the blade assembly. While plastic materials have been found which contain these particular qualities, regardless of the plastic which is used in the housing, when employed as a spring the material is susceptible to creep to a greater degree than that of a metal such as spring steel. However, metal or steel mechanisms increase cost and complexity of shaving cartridges.

In certain cartridge designs, fixed blades may be preferred to floating blades (i.e., blades that are movable in response to forces encountered during the shaving operation). Accordingly, it is even more difficult to provide a spring finger that provides sufficient force such that the blade members do not move in an up and down direction as the shaving cartridge is pressed against the surface of the skin during a shaving stroke (i.e., a fixed blade construction). In addition, spring finger biasing members are very limiting because they are difficult to injection mold and take up valuable space in the cartridge housing, especially as the number of blades increases and/or the spacing between the blades decreases. Thus, it is difficult to design a cartridge that has more blades and/or closer blade spacing.

Thus, there is a need for a shaving razor cartridge having a simple and reliable design to establish shaving geometry while facilitating an increased number of blades and/or closer blade spacing. What is also needed is a method and design to restrain the blade members in response to forces encountered during the shaving operation.

SUMMARY OF THE INVENTION

In one aspect, the invention features, in general a shaving razor cartridge with a housing having a guard and a cap. At least one blade is mounted to the housing. The at least one blade has a cutting edge. At least one blade registration member is mounted to the housing. A blade retention member secures the at least one blade between the blade registration member and the blade retention member. The blade registration member has an unsupported region having a span of 0.25 mm to 5 mm between a pair of supported regions.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
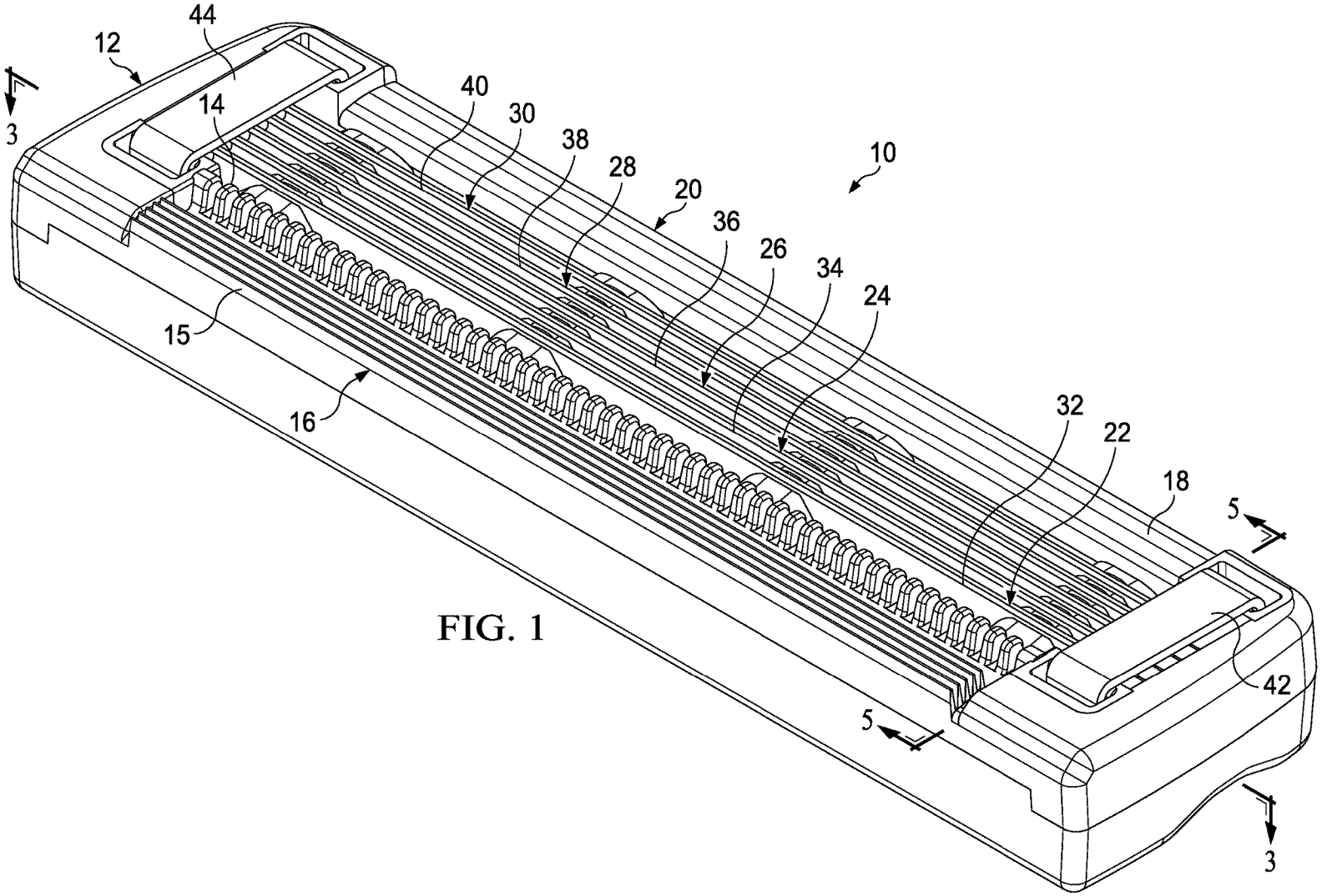
FIG. 1 is a perspective view of a shaving razor cartridge according to one possible embodiment of the present invention.

Referring to FIG. 1, a perspective view of a shaving razor cartridge 10 is shown. The shaving razor cartridge 10 may be mounted to a handle (not shown). The shaving razor cartridge 10 may be removable or permanently mounted to the handle. For example, the shaving razor cartridge 10 may be mounted detachably on a handle to enable the shaving razor cartridge 10 to be replaced by a fresh shaving razor cartridge 10 when the blade sharpness has diminished to an unsatisfactory level, or it may be attached permanently to the handle with the intention that the entire razor be discarded when the blade or blades have become dulled. The shaving razor cartridge 10 may include a housing 12. The housing 12 may be molded out of a rigid plastic or manufactured from other materials, such as metal. A guard 14 may be positioned at a front portion 16 of the housing and a cap 18 may be positioned at a rear portion 20 of the housing 12. In certain embodiments, the cap 18 may comprise one or more lubricants that are released during shaving.

The guard 14 is typically a unitary molded member that can be formed of a rigid plastic (e.g., the same material as the housing 12). The guard 14 may be a solid or segmented bar that extends generally parallel to the blades 22, 24, 26, 28 and 30 and supports the skin during a shaving stroke. In certain embodiments, the housing 12 may comprise a skin-engaging member 15 (e.g., a plurality of fins or other protrusions) in front of the guard 14 for stretching the skin during a shaving stroke. In certain embodiments, the skin-engaging member 15 may be insert injection molded or co-injection molded to the housing 12. However, other known assembly methods may also be used such as adhesives, ultrasonic welding, or mechanical fasteners. The skin engaging member 15 may be molded from a softer material (i.e., lower durometer hardness) than the housing 12, such as an elastomer.

One or more blades 22, 24, 26, 28 and 30 may be mounted to the housing 12 between the cap 18 and the guard 14 (i.e., in front of the cap 18 and behind the guard 14). The blades 22, 24, 26, 28 and 30 may each have a respective cutting edge 32, 34, 36, 38 and 40 generally directed towards the guard 14. A primary blade 22 may be nearest the guard 14, secondary blade 24 the next nearest the guard 14, and so on until the fifth blade 30 is furthest from the guard 14 (e.g., closest the cap 18). Although five blades 22, 24, 26, 28 and 30 are shown, the shaving razor cartridge 10 may have more or fewer blades depending on the desired performance and cost of the shaving razor cartridge 10. The guard 14 and the cap 18 may define a shaving plane that is tangent to the guard 14 and the cap 18. As will be described in greater detail below, the blades 22, 24, 26, 28 and 30 may be secured to the housing 12 with one or more blade retention members 42 and 44. In certain embodiments, the blade retention members 42 and 44 may be metal or plastic clips. The clips 42 and 44 may be spaced apart from each other and may be two separate components or interconnected. The clips 42 and 44 may also aid in establishing the exposure of the blades (i.e., the position of the cutting edges 32, 34, 36, 38 and 40 relative to the shaving plane). For example, the cutting edge 32, 34, 36, 38 and 40 may be biased against the clips 42 and 44.

Figure 2:
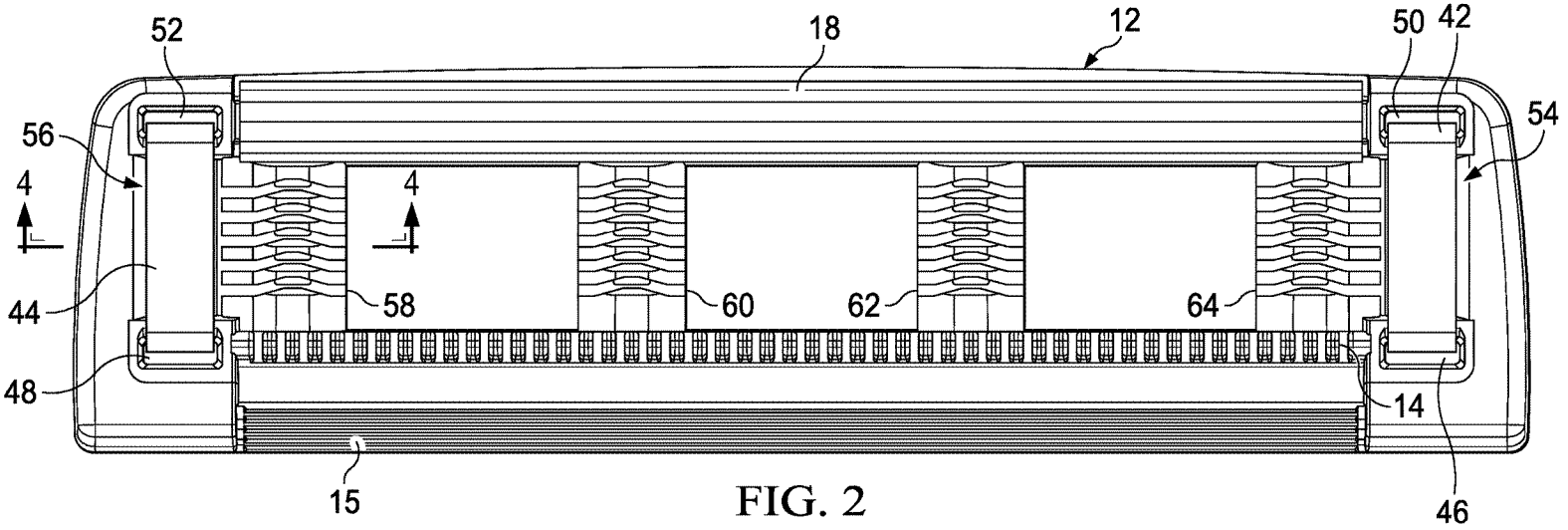
FIG. 2 is a top view of a housing, which may be incorporated into the shaving razor cartridge of FIG. 1.

Referring to FIG. 2, a top view of the housing 12 is shown. The housing 12 may be injection molded from a polymeric material. The housing 12 may be molded from polymers such as high impact polystyrene (HIPS), but other semi-rigid polymers such as polypropylene (PP), nylon, acrylonitrile butadiene styrene (ABS), polyphenylene ether, polystyrene, and combinations thereof may also be used. The housing 12 may define a pair of openings 46 and 48 adjacent the guard 14. For example, the guard 14 may be positioned between the pair of openings 46 and 48. The housing 12 may also define a second pair of openings 50 and 52 adjacent the cap 18. For example, the cap 18 may be positioned between the pair of openings 50 and 52. The openings 46, 48, 50 and 52 may be dimensioned to receive the clips 42 and 44 (not shown). At least one blade registration member 54 and 56 may be mounted to the housing 12. In certain embodiments, there may be two blade registration members 54 and 56 that extend generally parallel to each other. The blade registration members 54 and 56 may extend in a transverse direction from the guard 14 toward the cap 18. The registration members 54 and 56 may be positioned inboard of the guard 14 and the cap 18 in a front-rear direction and outboard from the guard 14 and the cap 18 in a lateral direction. The housing 12 may define one or more blade slots dimensioned to receive at least one of the blades 22, 24, 26, 28 and 30. For example, the blade slots 56, 58, 60 and 62 may be generally aligned with each other (e.g., extending along the same axis) and dimensioned to receive the primary blade 22 (not shown). More or less blade slots may be used depending on the number of blades and the amount of rigidity desired to hold the blades in place. It is understood that the other blades 24, 26, 28 and 30 may be received in similar blade slots. At least one of the blade registration members 54 and 56 may be positioned outboard of the blade slots 56, 58, 60 and 62 (i.e., the blade slots 56, 58, 60 and 62 may be positioned between the blade registration members 54 and 56) to improve securement of the blades.

Figure 3:
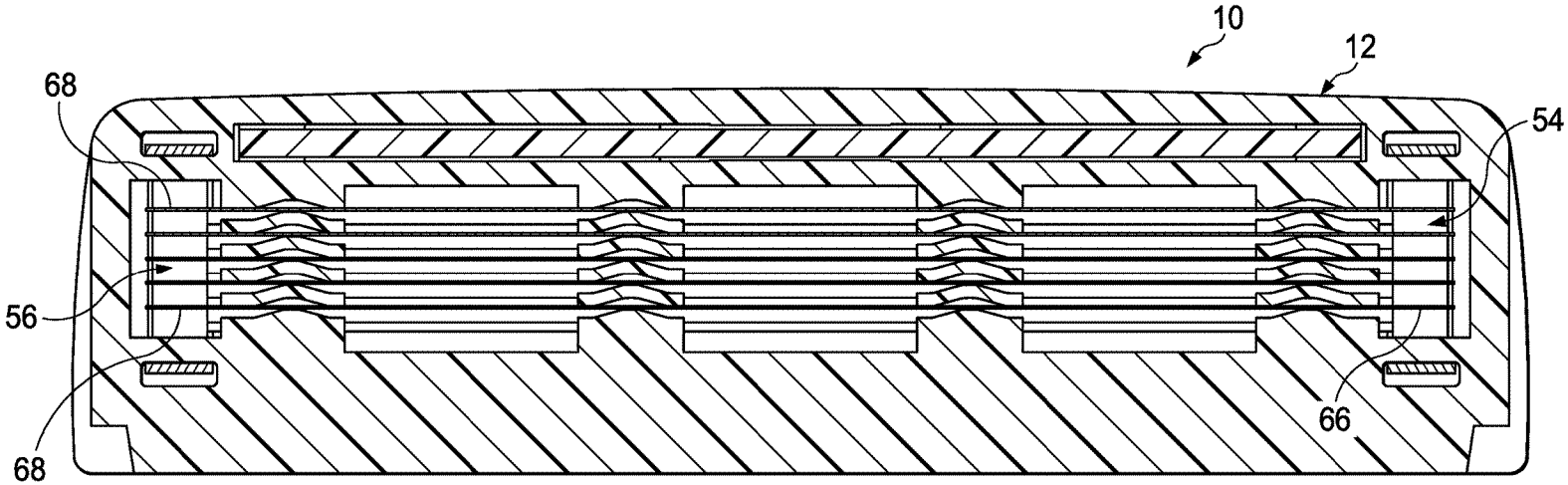
FIG. 3 is a cross section view of the shaving razor cartridge, taken generally along the line 3-3 of FIG. 1.

Referring to FIG. 3, a cross section view of the shaving razor cartridge 10 is shown, taken generally along the line 3-3 of FIG. 1. In certain embodiments, the blade registration members 54 and 56 may be spaced apart from each other. Accordingly, respective ends of each of the blades 22, 24, 26, 28 and 30 may rest on top of the blade registration members 54 and 56. For example the blade 22 may have a first end portion 66 and a second end portion 68 that contact the respective blade registration members 54 and 56. In certain embodiments, the blades 22, 24, 26, 28 and 30 may extend beyond the blade registration members 54 and 56. The blade registration members 54 and 56 may be spaced apart from each other (e.g., on opposite sides of the housing 12). However, the registration members 54 and 56 may also be interconnected. For example, the registration members 54 and 56 may be co-injection molded to the housing 12. The second shot of plastic or elastomer that forms the registration members 54 and 56 may also form the skin engaging member 15 and/or other surfaces of the housing 12. The co-injection molding process may bond the registration members 54 and 56 to the housing 12. Alternatively, the registration members 54 and 56 may be separate components that are secured to the housing. For example, the registration members 54 and 56 may be tubes or portions of tubes that are secured to the housing 12 with adhesive.

Figure 4:
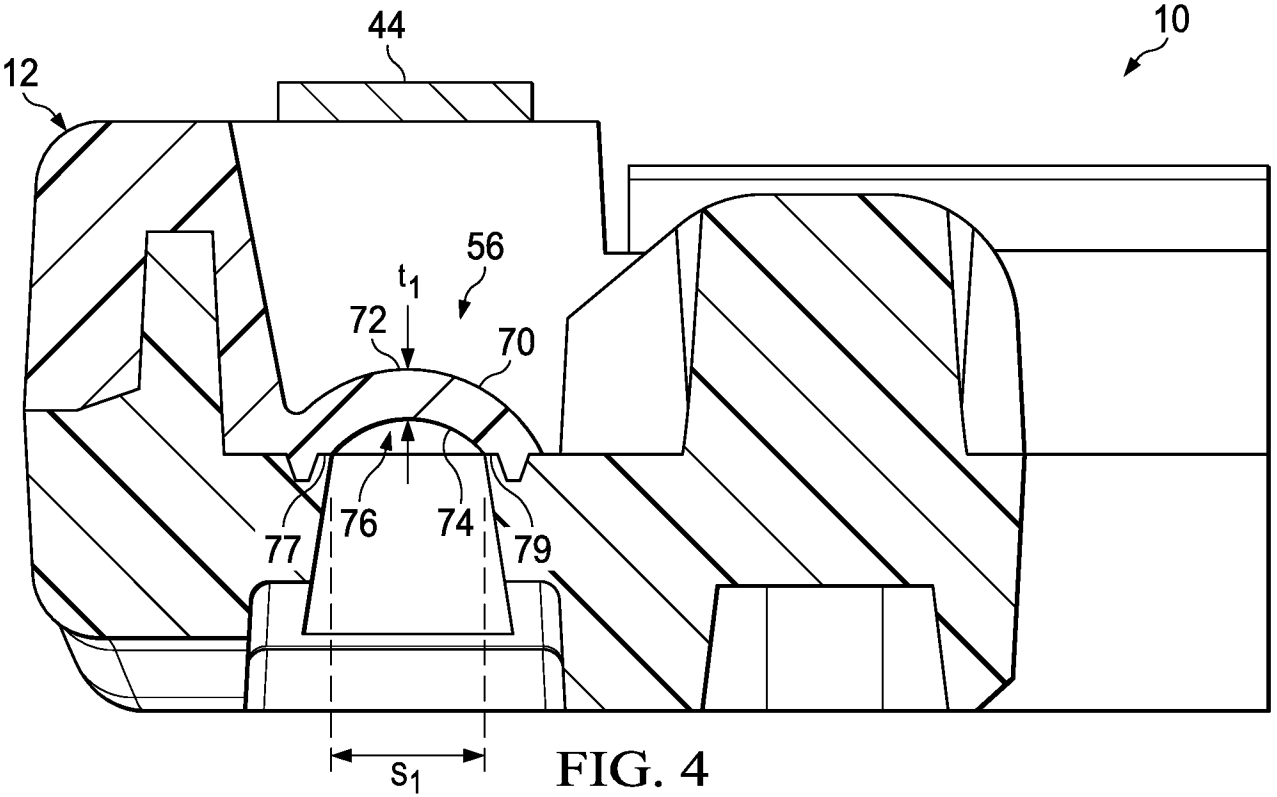
FIG. 4 is a cross section view of the shaving razor cartridge, taken generally along the line 4-4 of FIG. 1.

Referring to FIG. 4, a cross section of the shaving cartridge of FIG. 1 is shown, taken generally along the line 4-4 of FIG. 1. Although only one of the blade registration members 52 is shown, it is understood the other blade registration members 54 and 56 may have the same features and functions. The blade registration member 54 may have an arcuate top surface 70 with a crown 72 (i.e., upper most portion of the top surface 70) extending in a direction transverse to the guard 14 and/or cap 18 (i.e., the highest point of the top surface 70 extends in a direction transverse to the guard 14 and/or cap 18). The top surface 70 of the blade registration member 52 may be convex. The arcuate top surface 70 may aid in distributing force along the length of the arch to support greater loads than a beam of similar size might be able to support. Alternatively, the crown (72) may be a ridge (e.g., pyramid shape) or a flat surface. The blade registration member 54 may have a bottom surface 74 that is concave. However, other unsupported shapes and geometries are also possible for the bottom surface 74. In certain embodiments, the bottom surface 74 may be spaced apart from the housing 12 to provide an unsupported region 76. Accordingly, the bottom surface 74 may be unsupported to facilitate the blade registration member 54 to deflect and/or partially buckle as the blades are mounted to the housing 12. For example, the blade registration member 54 may partially collapse under a load of the blades during assembly and/or during a shaving stroke.

In certain embodiments, the blade registration member 54 may be positioned directly beneath the corresponding blade retention member 42. For example, the blade retention member 42 may overlap the unsupported region 76. The blade retention member 42 may even completely overlap the unsupported region 76. Accordingly, the blades 22, 24, 26, 28, and 30 (not shown) are put in direct compression to minimize bending moments, which may result in undesired deformation of the blades. The unsupported region 76 may have a span "S1" between a pair of supported regions 77 and 79 of about 0.25 mm to about 5 mm and a height of about 0 mm to 5 mm. The blade registration member 54 may have a thickness "t1" of about 0.2 mm to 5 mm depending on the desired force to support the blades 22, 24, 26, 28, and 30 against the corresponding blade retention member 42. As will be described in greater detail below, t1 may vary along the length of the blade registration member 54 (i.e., in a guard 14 to cap 18 direction)

Figure 5:
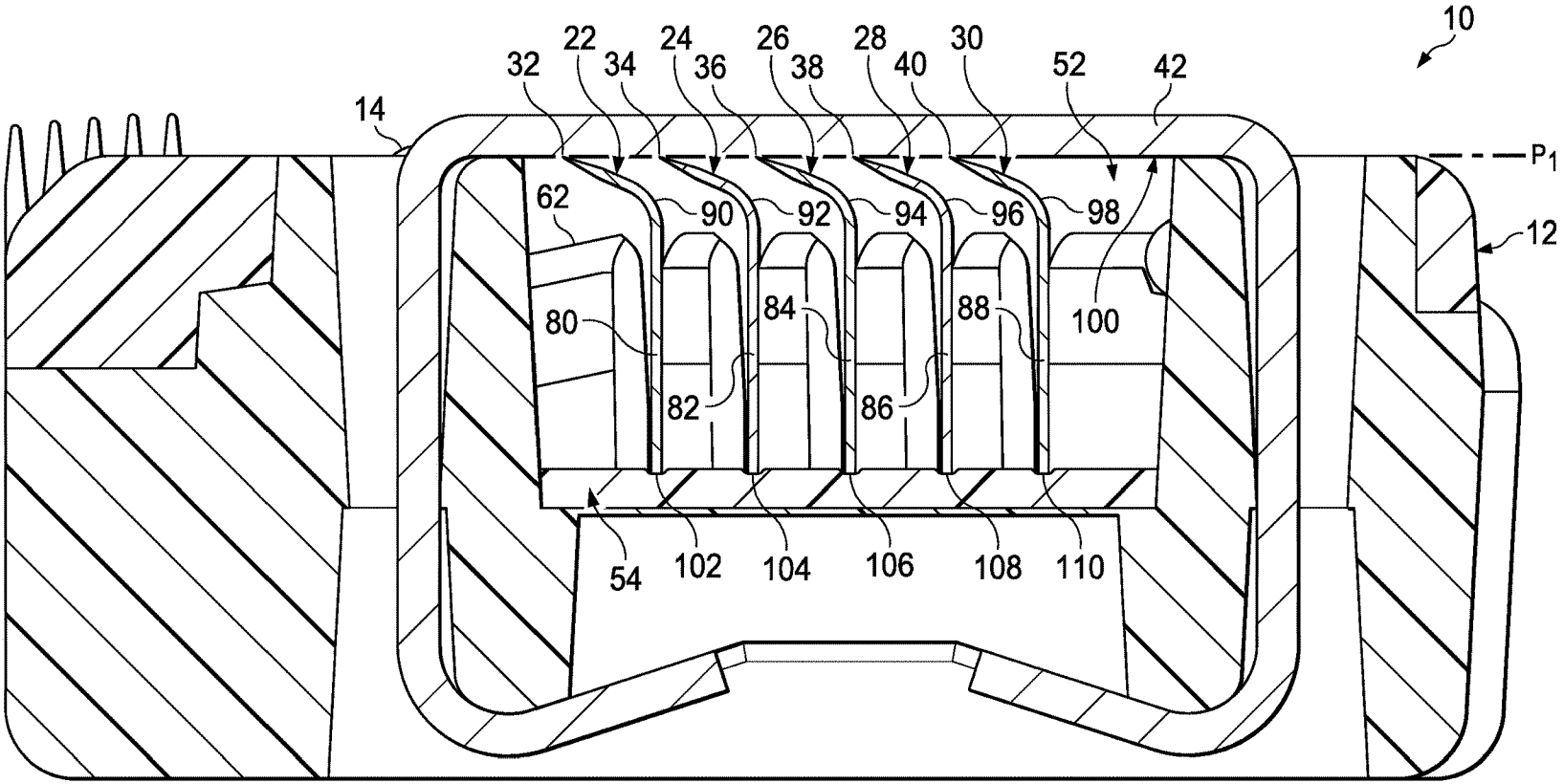
FIG. 5 is a cross section view of the shaving razor cartridge, taken generally along the line 5-5 of FIG. 1.

Referring to FIG. 5, as section view of the shaving cartridge 10 is shown, taken generally along the line 5-5 of FIG. 1. One or more of the blades 22, 24, 26, 28 and 30 may be a bent blade unit. For example, each blade 22, 24, 26, 28 and 30 may comprise a unitary member having a base portion 80, 82, 84, 86 and 88 and respective bent portion 90, 92, 94, 96 and 98 located between the respective cutting edge 32, 34, 36, 38 and 40 and the base portion 80, 82, 84, 86 and 88. The base portions 80, 82, 84, 86 and 88 may be generally parallel to each other and transverse to a shaving plane P1 that is tangent to the guard 14 and the cap 18. The base portions 80, 82, 84, 86 and 88 may have a corresponding bottom surface 102, 104, 106, 108 and 110. In other embodiments, the one or more of the blades may be welded blade assemblies (e.g., a blade welded having a cutting edge connected to a blade support having a base portion and a bent portion).

The blades 22, 24, 26, 28 and 30 may be positioned between the blade retaining members 42 and 44 and the blade registration members 54 and 56. The blade registration members 54 and 56 may account for differences in blade height tolerances by biasing the cutting edges of the 32, 34, 36, 38 and 40 of each blade 22, 24, 26, 28 and 30 against a bottom surface 100 of the blade retaining members 42 and 44. The blades 22, 24, 26, 28 and 30 may be mounted to the housing 12 and compressed into blade registration members 54 and 56 during the assembly process. For example, the base portions 80, 82, 84, 86 and 88 of the blades 22, 24, 26, 28 and 30 may be mounted to the housing 12 such that the bottom surfaces 102, 104, 106, 108, and 110 of the base portions 80, 82, 84, 86 and 88 contact the blade registration members 54 and 56. The blade retention members 42 and 44 may then compress the blades 22, 24, 26, 28 and 30 (e.g., the bottom surfaces 102, 104, 106, 108, and 110) into the blade retaining members 54 and 56 as the blade retention members 42 and 44 are secured to the housing 12. In certain embodiments, the base portion(s) 80, 82, 84, 86 and 88 may press into and/or deform the blade registration members 54 and 56. Although FIG. 5 illustrates the blade registration members 54 and 56 contacting the base portion(s) 80, 82, 84, 86 and 88, it is understood that the blade registration members 54 and 56 may contact any portion of the blades 22, 24, 26, 28 and 30 in order to bias the blades 22, 24, 26, 28 and 30 against the blade retention members 42 and 44. For example, the blade registration members 54 and 56 may contact a portion of the blades 22, 24, 26, 28 and 30 between the cutting edges of the 32, 34, 36, 38, and 40 and the respective base portion(s) 80, 82, 84, 86 and 88.

The blade registration members 54 and 56 may bias each of the blades 22, 24, 26, 28 and 30 against the corresponding blade retention member 42 and 44 at a force of about 4 grams to about 50 grams. For example, a floating blade system (i.e., contact between the blades and the blade retention member 42 and 44 is not maintained under normal shaving conditions) may have blade registration members 54 and 56 that are capable of biasing the blades 22, 24, 26, 28 and 30 against the corresponding blade retention member 42 and 44 at a force of about 4 g to about 25 g. A non floating blade system (i.e., contact between the blades and the blade retention member 42 and 44 is maintained under normal shaving conditions) the blade registration members 54 and 56 may be modified to support larger loads. If the force of an individual blade is too low, the blade may not contact the blade retention member 42 and 44 properly, thus negatively impacting shaving performance If the individual blade load is too high, the blades may not compress and/or partially buckle the blade registration members 54 and 56, which may cause the blades 22, 24, 26, 28 and 30 to be crushed during the assembly of the blade retention members 42 and 44.

The blade registration members 54 and 56 may comprise thermoplastic elastomers (TPEs), silicones, rubbers, and combinations thereof. In certain embodiments, the blade registration members 54 and 56 and the skin-engaging member 15 may be molded from the same material. Accordingly the housing 12 may be a single piece component utilizing multi-shot injection molding. The blade registration members 54 and 56 may be molded from materials having a shore A hardness of about 20 to about 70, and more preferably 40 to 60. If the material of the blade registration members 54 and 56 is too soft, the blades may slice into and tear blade registration members 54 and 56. Conversely, if the material of the blade registration members 54 and 56 is too hard, the blade registration members 54 and 56 may not deflect and/or partially buckle during blade loading, which may cause damage to the blades during assembly. For example, the blades may be secured between the clips 42 and 44 and the blade registration members 54 and 56. If the blade registration members 54 and 56 do not buckle, then the clips 42 and 44 may apply excessive force on the blades and crush them. In certain embodiments, the blade registration members 54 and 56 may have sufficient stiffness that the cutting edges of the blades remain in contact with the clips during a shaving stroke, thus providing a fixed blade arrangement.

The blade registration members 54 and 56 may eliminate or minimize several issues of spring fingers, which are commonly used to register the blades against a registration surface, such as clips. For example, spring fingers can be difficult to mold and can be 12 susceptible to breaking. In addition, more expensive engineering polymeric materials must be used to provide sufficient strength under the load of the blades. The blade registration members 54 and 56 blades may also allow for the spacing between the blades (i.e., blade span) to be decreased because each blade does not require a separate spring member. As blade spans decrease, the size of individual spring members, such as spring fingers, must also decrease. Smaller spring fingers may not provide sufficient force to bias the blades against a registration surface, such as the clips.

The blade registration members 54 and 56 may be molded from materials having a shore A hardness of about 20 to about 70, such as thermoplastic elastomers (TPEs), silicones, rubbers, and combinations thereof. In certain embodiments, the blade registration members 54 and 56 and the skin-engaging member 15 may be molded from the same material. The elastomeric material may facilitate the blade registration members 54 and 56 pushing the blades against the blade retention members 54 and 56.

Figure 6:
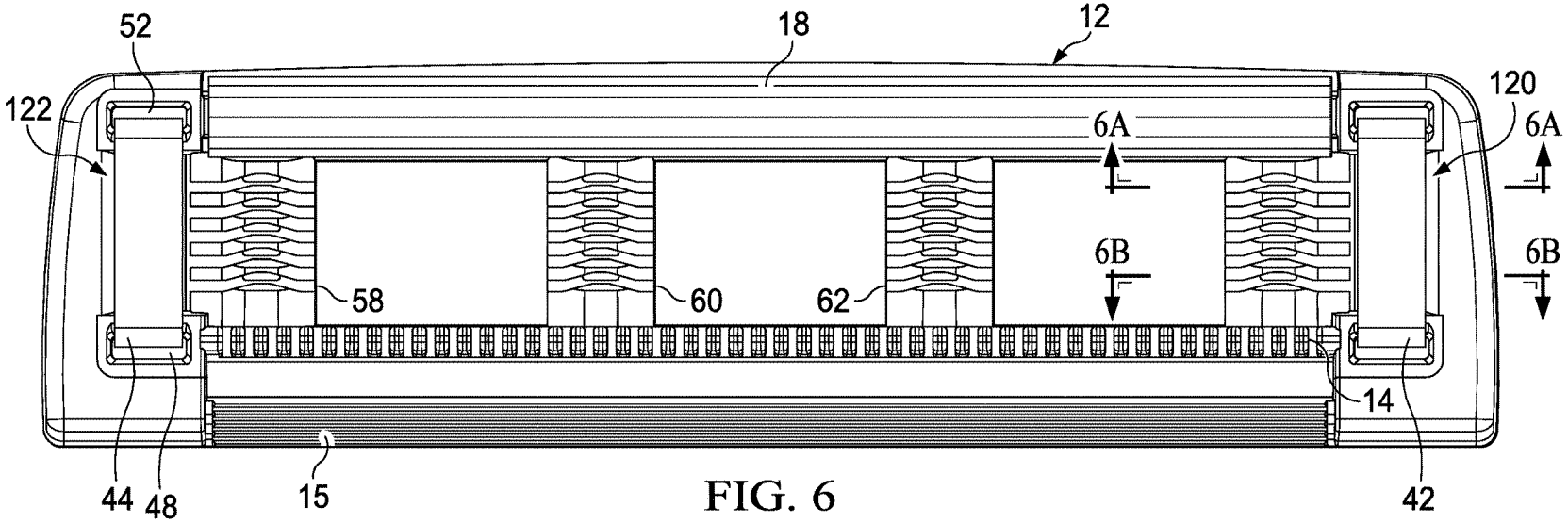
FIG. 6 is a top view of an alternative embodiment of a housing, which may be incorporated into the shaving razor cartridge of FIG. 1.
Figure 6A:
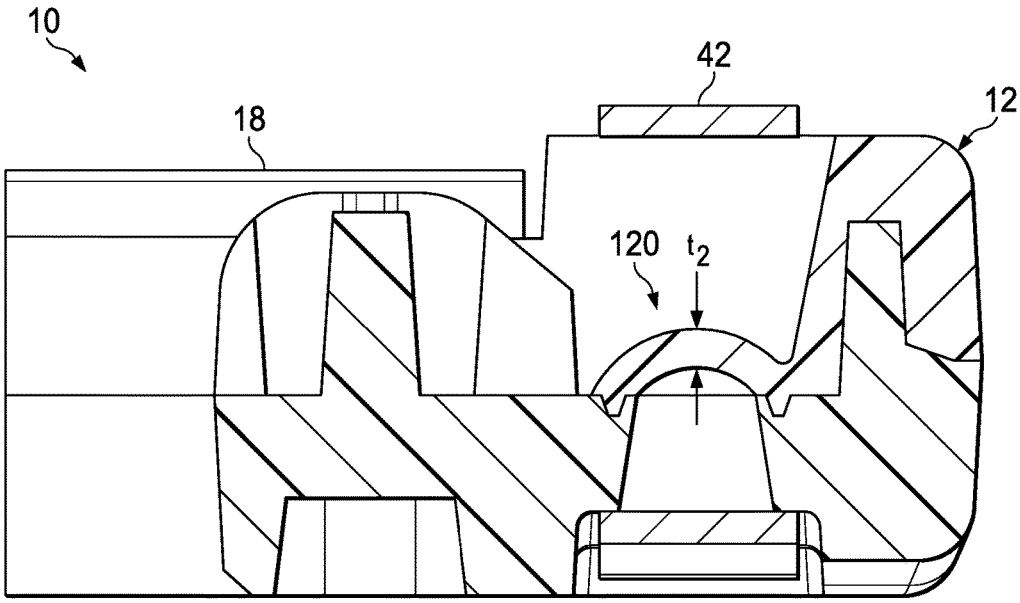
FIG. 6A is a cross section view of the housing, taken generally along the line 6A-6A of FIG. 6.
Figure 6B:
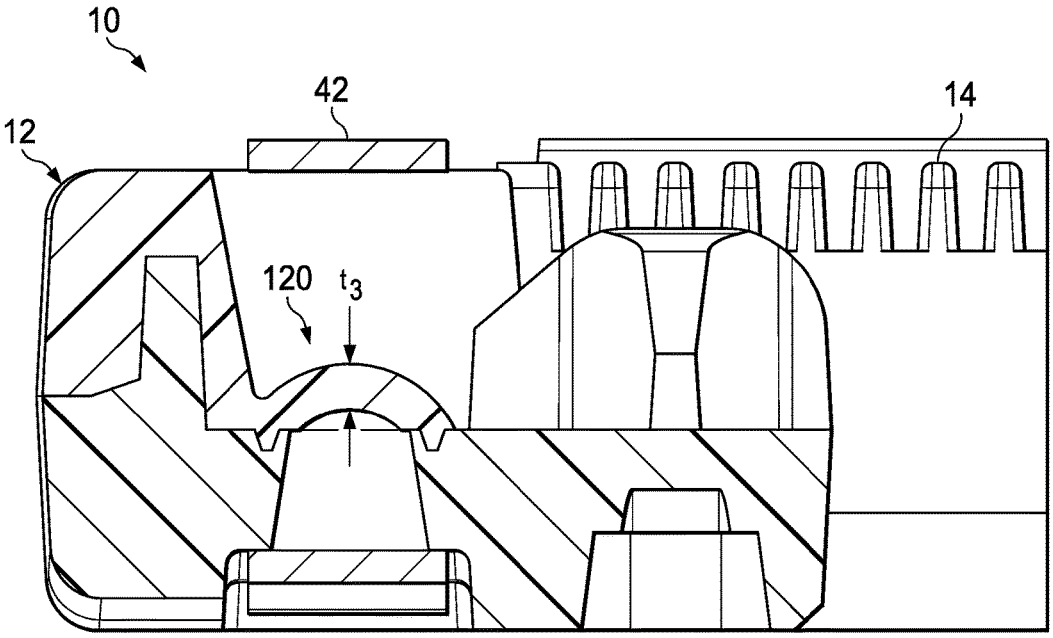
FIG. 6B is a cross section view of the housing, taken generally along the line 6B-6B of FIG. 6.

Referring to FIGS. 6, 6A and 6B an alternative embodiment of a pair of blade registration members 120 and 122 is shown, which may be incorporated into the shaving razor cartridge 10 and/or housing 12 of FIG. 1. The housing 12 is shown in FIG. 6 with the blades removed for clarity. The housing 12 shown in FIG. 6 may be the same as the housing 12 previously described. However, the housing 12 of FIG. 6 includes the blade registration members 120 and 122 having a variable wall thickness. FIG. 6A is a cross section view of the housing 12, taken generally along the line 6A-6A toward the cap 18 of FIG. 6. FIG. 6B is a cross section view of the housing, taken generally along the line 6B-6B toward the guard 14 of FIG. 6. Although FIGS. 6A and 6B show only one blade registration member 120, it is understood that blade registration member 122 may be the same as the blade registration member 120. FIG. 6A illustrates the blade registration members 120 and 122 (not shown) having a wall thickness "t2". FIG. 6B illustrates the blade registration members 120 and 122 (not shown) having a wall thickness "t3" that is greater than wall thickness "t4". In certain embodiments, it may be desirable to have a different force exerted by the blade registration members 120 and 122 (not shown) against different blades. For example, the blade closest to the cap 18 may be a fixed blade (i.e., maintains contact with the blade retention members during a shaving stroke) and the blade closest to the guard 14 may be a floating blade (i.e., does not maintain contact with the blade retention members during a shaving stroke). Accordingly, the wall thickness "t2" of the blade registration members 120 and 122 (not shown) contacting the last blade (i.e., the blade closest to the cap) may be less than the wall thickness "t3" of the blade registration members 120 and 122 (not shown) contacting the first blade (i.e., the blade closest to the guard).

It may also be desirable to have the force exerted against each of the blades to increase in a direction from the guard 14 to the cap 18. For example, the force exerted against the first blade may be less than the force exerted against the second blade, the force exerted against the second blade may be less than the force exerted against the third blade, the force exerted against the fourth blade may be greater than the force exerted against the third blade, and the force exerted against the fifth blade may be greater than the force exerted against the fourth blade. The increase in force may be created by increasing the wall thickness of the blade registration members 120 and 122. It is also understood, the force exerted against the blades may decrease in a direction from the guard to the cap.

Figure 7A:
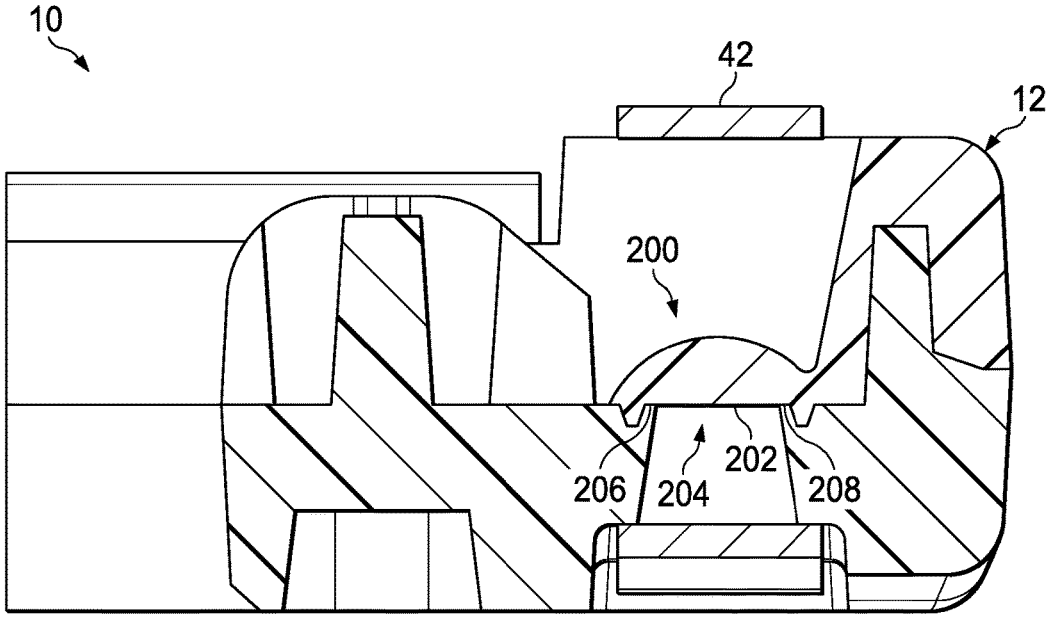
FIGS. 7A-7F are cross section views of other possible embodiments of the housing, which may be incorporated into the shaving razor cartridge of FIG. 1.
Figure 7B:
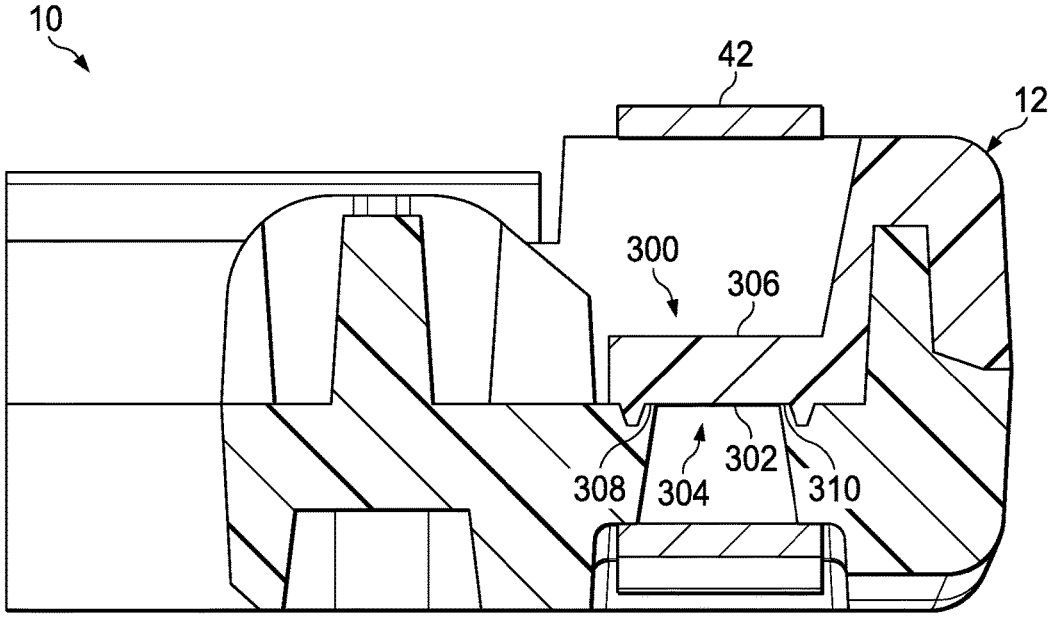
Figure 7C:
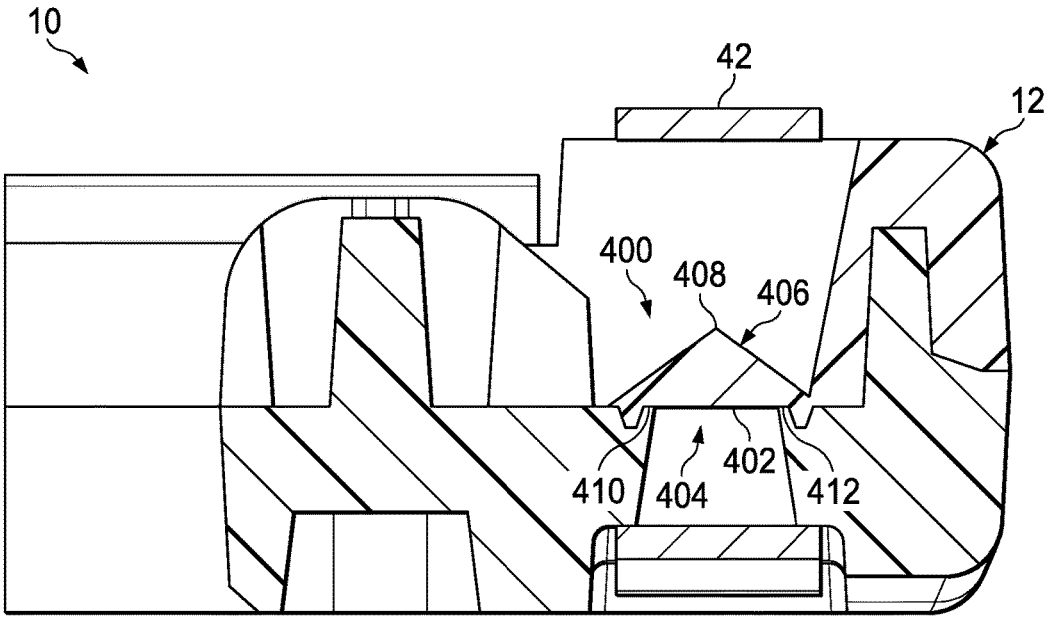
Figure 7D:
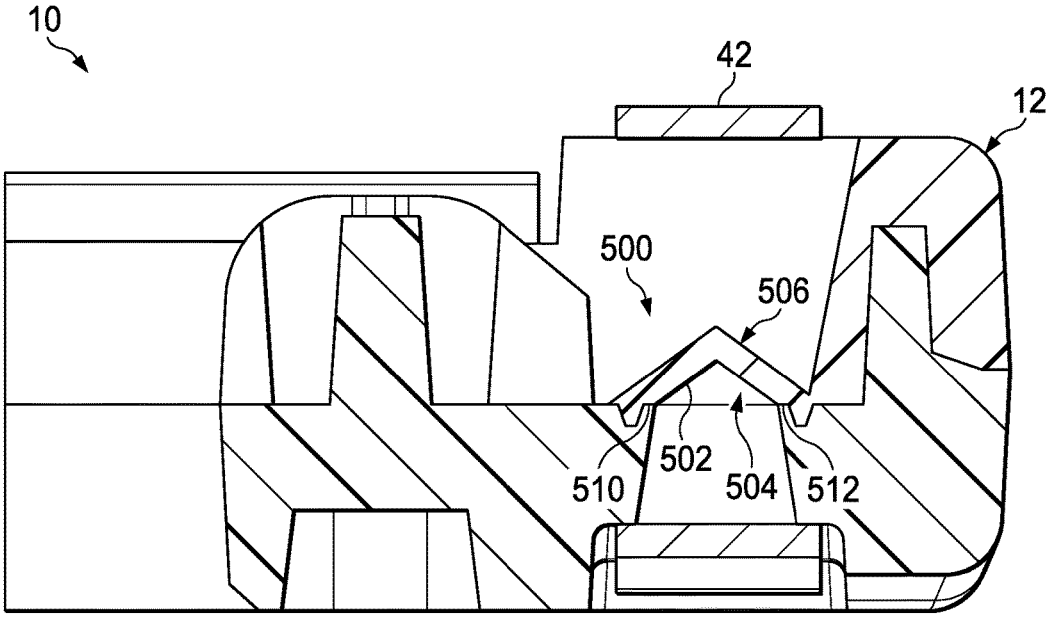
Figure 7E:
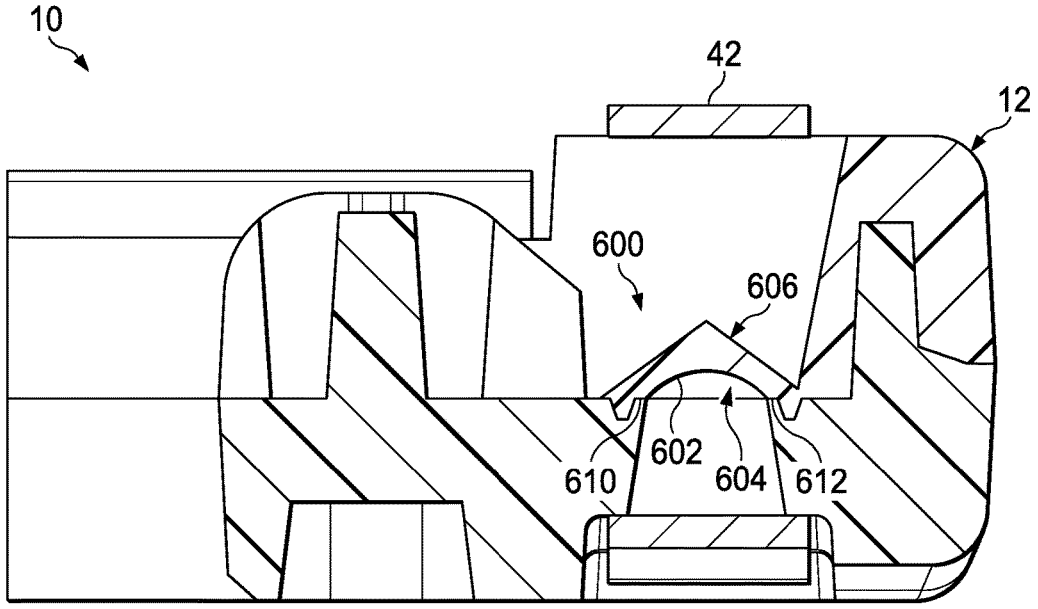
Figure 7F:
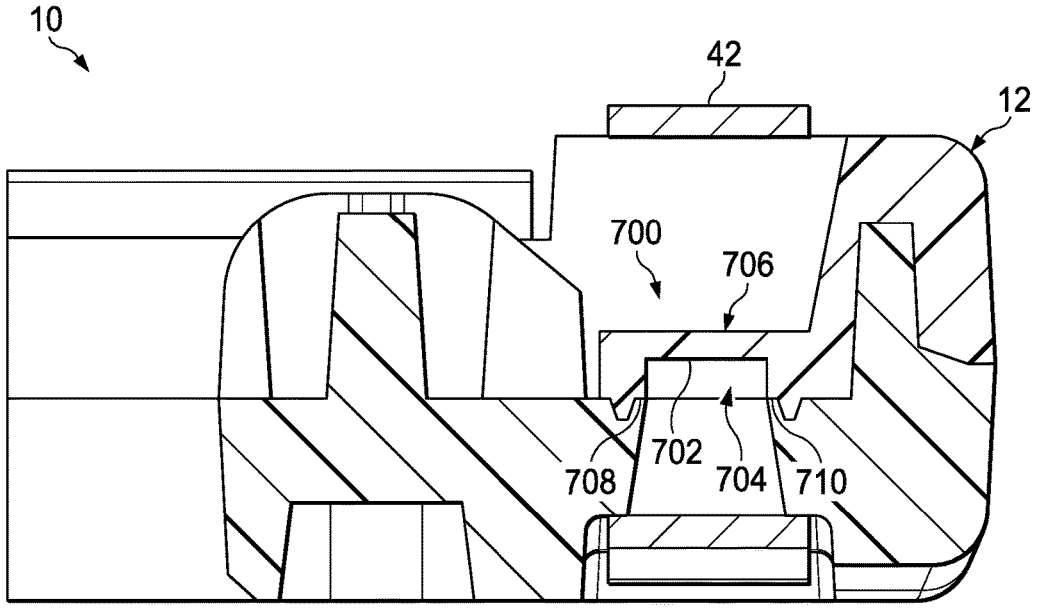

FIGS. 7A-7F are cross section views of other possible embodiments of blade registration members, which may be incorporated into the shaving razor cartridge 10 and/or housing 12 of FIG. 1. The blade registration members may have several possible geometries for the top and/or bottom surfaces to facilitate biasing the blades against the respective blade retention members. It is understood that for FIGS. 7A-7F even though only one blade registration member is shown in the various cross section views, there is another corresponding blade registration member that is a mirror image of the one shown. As shown in FIG. 7A, a blade registration member 200 may be similar to the blade registration members 54 and 56 described above; however, the blade registration member 200 may have a bottom surface 202 defining an unsupported region 204 that lies on a single plane (i.e., the unsupported region 204 does not extend into the registration member 200) that spans between a pair of supported regions 206 and 208 (e.g., supported by the housing 12). Accordingly, the registration member 200 allows for a wall thickness of the blade registration member 200 to be increased. FIGS. 7B and 7C illustrate other embodiments of blade registration members 300 (see FIG. 7B) and 400 having a bottom surface 302 and 402 defining an unsupported region 304 and 404 that lie on a single plane. The unsupported region 304 may span between a pair of supported regions 308 and 310 (e.g., supported by the housing 12). The unsupported region 404 may span between a pair of supported regions 410 and 412 (e.g., supported by the housing 12). The blade registration member 300 of FIG. 7B may have a top surface 306 that is flat. The blade registration member 400 of FIG. 7C may have a top surface 406 that is angled with a top edge forming a crown 408. FIG. 7D illustrates a blade registration member 500 having a bottom surface 502 defining an unsupported region 504 that extends into the blade registration member 500. The unsupported region 504 may span between a pair of supported regions 510 and 512 (e.g., supported by the housing 12). The bottom surface 502 may define an included angle of about 20 degrees to about 160 degrees. The blade registration member 500 may have a top surface 506 that is similar to the top surface 406 of FIG. 7C. FIG. 7E illustrates blade registration member 600 having a bottom surface 602 defining an unsupported region 604 that extends into the blade registration member 600 than spans between a pair of supported regions 610 and 612 (e.g., supported by the housing). The bottom surface 602 may be curved (e.g., concave). The blade registration member 600 may have a top surface 606 that is similar to the top surface 406 of FIG. 7C and the top surface 506 of FIG. 7D. FIG. 7F illustrates a blade registration member 700 having a bottom surface 702 that is flat and defines an unsupported region 704 that extends into the blade registration member 700. The unsupported region 704 may span between a pair of supported regions 708 and 710 (e.g., supported by the housing 12). The blade registration member 700 may have a flat top surface 706. Accordingly, numerous combinations of bottom and top surfaces are possible for the blade registration member to achieve desired forces to bias the blades against the blade retention members. For example, extending an unsupported region into the blade registration member may lower the force required to buckle the blade registration member, which may be desirable if the blade is thin or weak and is thus susceptible to damage during assembly.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited.

The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing having a guard and a cap;

at least one blade mounted to the housing between the guard and the cap, the at least one blade having a cutting edge and a base portion having a bottom surface;

at least one blade registration member mounted to the housing, the blade registration having a bottom surface with pair of supported regions contacting the housing and an unsupported region therebetween that is spaced apart from the housing;

a blade retention member securing the at least one blade between the blade registration member and the blade retention member, wherein the unsupported region contacts the bottom surface of the base portion and has a span of about 0.25 mm to about 5 mm between a pair of supported regions and the blade registration member and housing are a unitary member and the at least one blade registration member comprises an elastomeric material to facilitate the blade registration member pushing the at least one blade against the blade retention member.

2. The shaving razor cartridge of claim 1 wherein the blade registration member maintains the cutting edge against the blade retention member during a shaving stroke.

3. The shaving razor cartridge of claim 1 wherein the blade registration member comprises two blade registration members that are spaced apart from each other and are parallel to each other.

4. The shaving razor cartridge of claim 3 wherein the at least one blade has a first end portion and a second end portion that each contact one of the blade registration members.

5. The shaving razor cartridge of claim 1 wherein the blade registration member has a top surface with a crown extending in a direction transverse to the guard and the cap.

6. The shaving razor cartridge of claim 5 wherein the top surface is convex.

7. The shaving razor cartridge of claim 1 wherein the blade registration member has a bottom surface that is concave.

8. The shaving razor cartridge of claim 1 wherein the at least one blade at least partially buckles and compresses the blade registration member to bias the cutting edge against a bottom surface of the blade retention member.

9. The shaving razor cartridge of claim 1 wherein the blade registration member comprises a material having a Shore A hardness that is less than a material comprising the housing.

10. The shaving razor cartridge of claim 1 wherein the blade retention member comprises a pair of spaced apart clips.

11. The shaving razor cartridge of claim 10 wherein the blade registration member is positioned directly beneath the corresponding blade retention member.

12. The shaving razor cartridge of claim 1 further comprising an elastomeric skin engaging member in front of the guard.

13. The shaving razor cartridge of claim 12 wherein the blade registration member and the elastomeric skin engaging member are a unitary member.

14. The shaving razor cartridge of claim 1 wherein a material comprising the blade registration member has a modulus that is less than a modulus of a material comprising the housing.

15. A shaving razor cartridge comprising:

a housing having a guard and a cap;

at least one blade mounted to the housing between the guard and the cap, the at least one blade having a cutting edge and a base portion having a bottom surface;

at least one blade registration member mounted to the housing, the blade registration having a bottom surface with pair of supported regions contacting the housing and an unsupported region spaced apart from the housing;

a blade retention member securing the at least one blade between the blade registration member and the blade retention member, wherein the unsupported region has a span of about 0.25 mm to about 5 mm between the pair of supported regions to facilitate the blade registration member to deflect and/or partially buckle and the bottom surface of the base portion is compressed into the at least one blade registration member.

16. The shaving razor cartridge of claim 15 wherein the blade registration member comprises two blade registration members that are spaced apart from each other and are parallel to each other.

17. The shaving razor cartridge of claim 16 wherein the at least one blade has a first end portion and a second end portion that each contact one of the blade registration members.

18. The shaving razor cartridge of claim 15 wherein the blade registration member has a top surface with a crown extending in a direction transverse to the guard and the cap.

19. The shaving razor cartridge of claim 18 wherein the top surface is convex.

20. The shaving razor cartridge of claim 19 wherein the blade registration member has a bottom surface that is concave.

* * * * *